US007921758B2

(12) United States Patent
Eden et al.

(10) Patent No.: US 7,921,758 B2
(45) Date of Patent: Apr. 12, 2011

(54) IMPACT PANELS

(75) Inventors: Dale Eden, Spring, TX (US); Ronnie Stover, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 12/014,476

(22) Filed: Jan. 15, 2008

(65) Prior Publication Data

US 2008/0190277 A1 Aug. 14, 2008

Related U.S. Application Data

(60) Provisional application No. 60/889,072, filed on Feb. 9, 2007.

(51) Int. Cl.
*F41H 7/00* (2006.01)

(52) U.S. Cl. ..... 89/36.07; 175/219; 405/303

(58) Field of Classification Search ..... 175/219; 89/36.01

See application file for complete search history.

(56) References Cited

U.S. PATENT DOCUMENTS 3,626,836 A * 12/1971 Schneidler ..... 454/339
3,994,105 A 11/1976 Jamison et al.
4,124,320 A * 11/1978 Rapata ..... 403/163
4,566,237 A 1/1986 Turner
4,628,826 A 12/1986 Richter
5,026,219 A * 6/1991 Wallace ..... 405/303
5,109,934 A 5/1992 Mochizuki
5,200,256 A * 4/1993 Dunbar ..... 428/212
5,306,557 A * 4/1994 Madison ..... 428/304.4
5,635,288 A * 6/1997 Park ..... 428/105
5,635,306 A 6/1997 Minamida et al.
6,647,855 B1 * 11/2003 Christiansen et al. ..... 89/36.01
6,745,852 B2 6/2004 Kadaster et al.
6,962,030 B2 11/2005 Conn
7,306,055 B2 12/2007 Barnes
7,308,847 B2 12/2007 Walker
7,308,953 B2 12/2007 Barnes
7,325,599 B2 * 2/2008 Barker ..... 166/81.1
7,340,779 B2 * 3/2008 Chiou ..... 2/2.5

* cited by examiner

*Primary Examiner* — Troy Chambers
*Assistant Examiner* — Samir Abdosh
(74) *Attorney, Agent, or Firm* — Michael M. Dae; David Cate; Robin Nava

(57) ABSTRACT

A technique enables improved performance of oilfield service operations. A protective shield is formed with a portable stand and at least one lightweight impact panel. The one or more lightweight impact panels enable easy movement of the safety shield from one location to another at a given well site or between different well sites, thus affording protection with a minimum of labor and set up time. The safety shield can be used to provide protection during individual operations and/or to segregate and protect independent operations from each other during multiple, simultaneous operations.

12 Claims, 3 Drawing Sheets

IMPACT PANELS

CROSS-REFERENCE TO RELATED APPLICATION

The present document is based on and claims priority to U.S. Provisional Application Ser. No. 60/889,072, filed Feb. 9, 2007.

BACKGROUND

In many well related operations, a variety of devices and systems are used in performing oilfield services. Some applications utilize the devices and systems in simultaneous operations (SIMOPS) at a given well site. The well site may have multiple wellheads with various operations being performed simultaneously. For example, well stimulation operations can be performed concurrently with perforation operations and drilling operations.

The multiple wellheads at which simultaneous operations are performed often are in close proximity to each other. Additionally, the simultaneous operations can be performed by several different service companies. Because of the concurrent service operations and the close proximity of wellheads, the simultaneous operations potentially can create hazards. For example, breakages, ruptures, or other failures at one wellhead can create detrimental effects at adjacent wellheads. Attempts have been made to create a barrier between operations by erecting panels of steel. However, such panels are heavy, difficult to move from one position or location to another, and the installation of such panels proves labor and time intensive.

SUMMARY

In general, the present invention provides a system and method for use in performing oilfield service operations. A safety shield is formed with a portable stand and at least one lightweight impact panel. The stand and the at least one lightweight impact panel enable easy movement of the safety shield from one well site location to another as needed during well service operations, e.g. during multiple simultaneous operations. The safety shield can be used to provide protection during individual operations and/or to segregate and protect independent operations from each other.

BRIEF DESCRIPTION OF THE DRAWINGS

Certain embodiments of the invention will hereafter be described with reference to the accompanying drawings, wherein like reference numerals denote like elements, and.

DETAILED DESCRIPTION

In the following description, numerous details are set forth to provide an understanding of the present invention. However, it will be understood by those of ordinary skill in the art that the present invention may be practiced without these details and that numerous variations or modifications from the described embodiments may be possible.

The present invention generally relates to a lightweight portable safety shield useful in oilfield service operations and very well suited for simultaneous operations. The safety shield comprises a portable stand, such as a fabricated stand, fitted with one or more impact panels. The impact panels are made of a lightweight material that is easy to move. In one embodiment, the lightweight impact panels can be hand carried to facilitate quick and easy movement of the safety shield from one well site location to another. Depending on the size of the safety shield, the impact panels can be moved while joined with the portable stand or separated from the portable stand.

The lightweight nature of the portable safety shield enables rapid and inexpensive set up and tear down to facilitate deployment and movement of the portable shield from one location to another. By way of example, the lightweight panels can be constructed from a non-metallic material that is substantially lighter than steel. In one embodiment, the lightweight panels are constructed from a Kevlar® fiber material, such as a sheeted Kevlar® fiber material, available from the DuPont™ corporation, or similar lightweight, impact resistant materials.

The lightweight portable safety shield provides short-term impact protection at the well site to provide well site workers with enough time to get out of harms way in the event of a problem at one of the wells. The safety shield can be used for an individual operation, e.g. a maintenance operation, or it can be used in a simultaneous operations field to segregate and protect the independent operations from each other.

Figure 1:
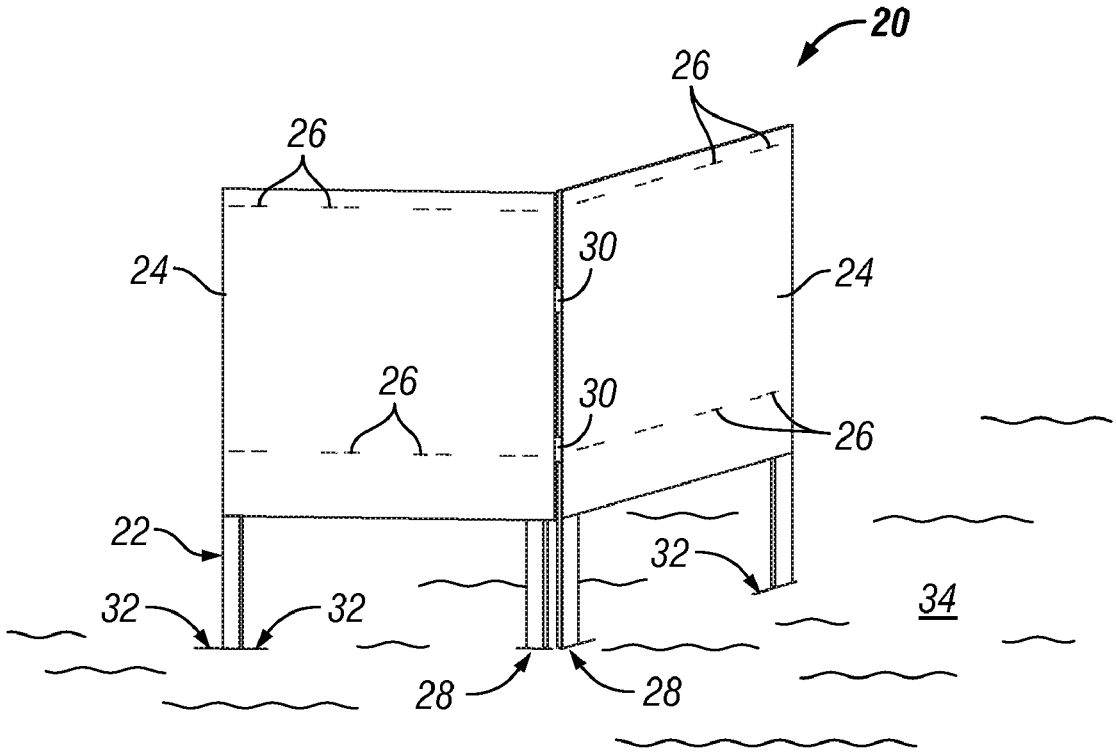
FIG. 1 is a perspective front view of one example of a safety shield having a plurality of lightweight impact panels, according to an embodiment of the present invention.

Referring generally to FIG. 1, one embodiment of a lightweight, portable safety shield 20 is illustrated. In this embodiment, shield 20 comprises a stand or framework 22, such as a fabricated stand. One or more lightweight impact panels 24 are mounted to the stand 22. The impact panels 24 can be mounted to stand 22 via a plurality of fasteners 26 which may take a variety of forms depending on the construction of stand 22 and impact panels 24. For example, fasteners 26 may comprise hooks, pins and corresponding recesses, bolts, and other suitable fasteners. The fasteners 26 can be selected to enable quick connection and disconnection of the impact panels 24 and stand 22 to further facilitate movement, transport, and/or storage.

Additionally, stand 22 can be constructed in sections 28 to enable selective changing or adjustment of the stand configuration and the relative orientation of the lightweight impact panels 24 to accommodate a variety of wellhead and space constraints. The individual sections 28 can be connected together by appropriate connectors 30. By way of example, connectors 30 may comprise hinges that enable the sections 28 of stand 22 to be pivoted relative to one another. A variety of securing devices 32, such as bolts, pins, or other fasteners, also can be used to secure stand 22 to a desired surface 34, such as a surface of the earth or a platform.

Figure 2:
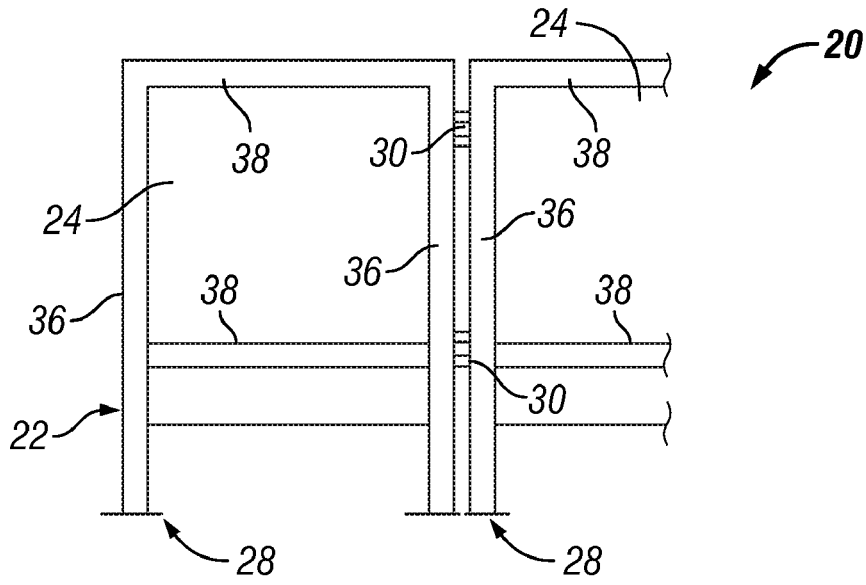
FIG. 2 is a back view of the safety shield, according to an embodiment of the present invention.

The stand 22 can be fabricated in a variety of sizes and configurations depending on the environment and applications in which it is used to provide protection. As illustrated in FIG. 2, for example, the stand 22 can be fabricated with a variety of vertical elements or legs 36 that are connected by transverse structural members 38. The transverse structural members 38 may be arranged horizontally or at other angles selected to achieve a desired structural strength.

Figure 3:
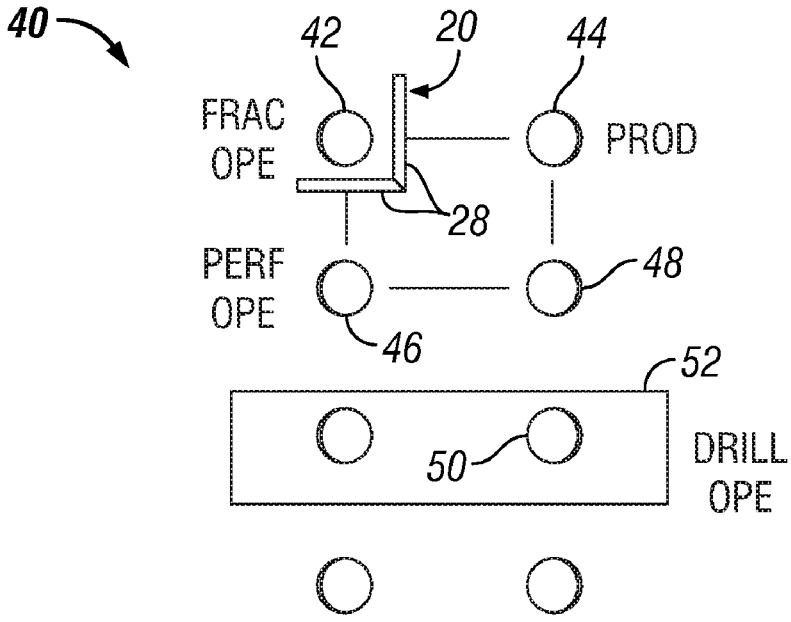
FIG. 3 is an overhead schematic view of a well site undergoing simultaneous operations with a safety shield deployed in one example configuration, according to an embodiment of the present invention.

In FIG. 3, one embodiment of a well site at which safety shield 20 can be implemented is illustrated. In this embodiment, the safety shield 20 is deployed at a simultaneous operations field 40. By way of example, field 40 has multiple wellheads 42, 44, 46, 48, 50 at which various well related operations are being performed concurrently. For example, a well stimulation operation, e.g. a fracturing operation, can be conducted at wellhead 42 while wellhead 44 is in production. Additionally, a perforating operation can be performed at wellhead 46, and a drilling operation can be conducted from a drilling platform 52 at wellhead 50.

In this particular example, one embodiment of safety shield 20 is deployed in proximity to wellhead 42 where well stimulation operations are being performed. Safety shield 20 is deployed in a configuration that segregates wellhead 42 from the adjacent wellheads 44, 46, 48, 50 and provides protection for any workers/personnel that are active by these other wellheads. In the event of a problem, such as a failure in treating lines at wellhead 42, safety shield 20 protects the surrounding area from potentially impacting materials.

It should be noted that the simultaneous operations field 40 is provided as one example. The number of wellheads, placement of the wellheads, type of operations, actual services being conducted simultaneously, and other well related factors can vary from one application to another. Additionally, the configuration and the size of safety shield 20 can vary according to environment, topography, wellhead and operations being conducted. Additional safety shields 20 also can be deployed around other wellheads, or the sequence of service operations can be selected to accommodate movement of one or more safety shields 20.

Figure 4:
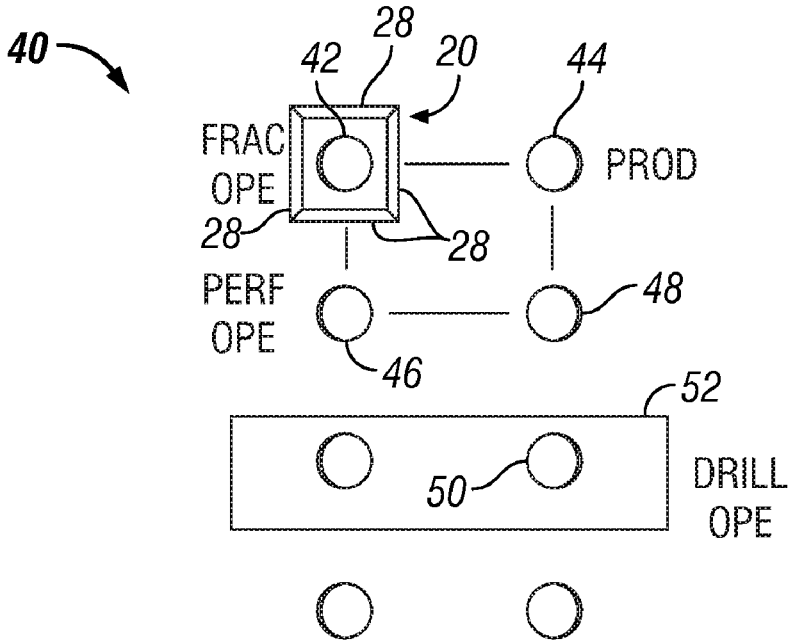
FIG. 4 is an overhead schematic view of a well site undergoing simultaneous operations with a safety shield deployed in another example configuration, according to another embodiment of the present invention.

Also, the geometry, orientation and number of safety shield sections 28 can be changed according to the environment, operations being performed, and orientation of the wellheads at a particular well site. As illustrated in FIG. 4, for example, safety shield 20 can be installed around an entire wellhead, such as wellhead 42. In the illustrated embodiment, safety shield 20 establishes a circumference around the wellhead undergoing fracturing operations. The safety shield also can be used to create a circumference around wellhead 46 undergoing perforation operations or around other wellheads as suited for a given application. In the embodiment illustrated in FIG. 4, safety shield 20 comprises four sections 28, however other numbers of sections can be utilized to create the circumference or other shield configuration.

Figure 5:
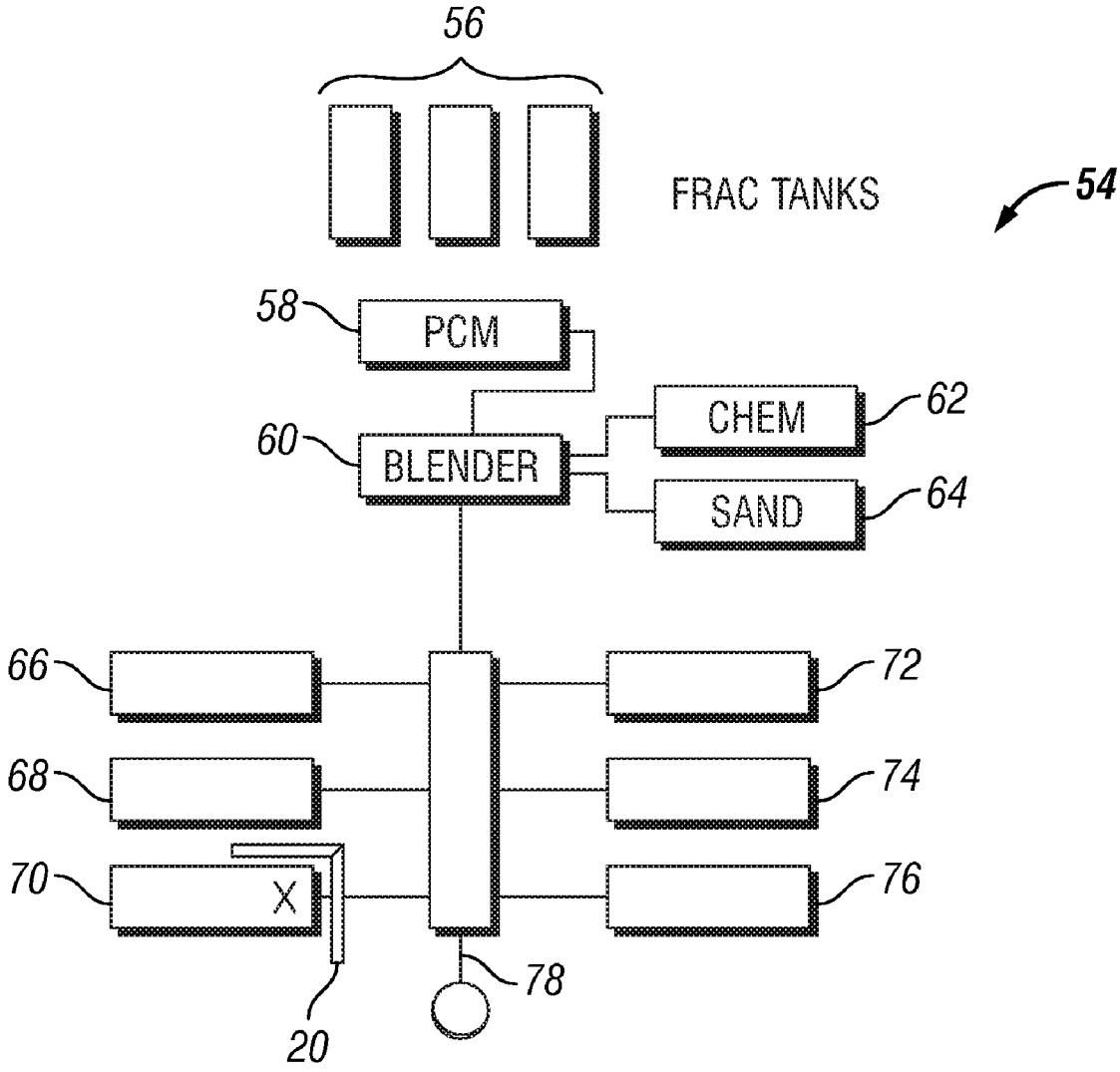
FIG. 5 is an overhead schematic view of a well site undergoing simultaneous operations with a safety shield deployed in another example configuration, according to another embodiment of the present invention.

The use of safety shield 20 is not limited to simultaneous operations. As illustrated in FIG. 5, for example, an embodiment of safety shield 20 is deployed in an individual oilfield service operation. In the example illustrated, safety shield 20 is used in a well stimulation operation at a well stimulation site 54. The equipment used at site 54 can vary from one service application to another. In this example, however, the well stimulation site may utilize frac tanks 56, a PCM (precision continuous mixer) 58, a blender 60, a chemical tank or hopper 62, a sand tank or hopper 64, and multiple frac pumps 66, 68, 70, 72, 74, 76. The frac pumps are connected with high-pressure treating iron 78.

The safety shield 20 can be set up and/or moved quickly and easily to provide desired protection at a variety of locations throughout well stimulation site 54. If, for example, one of the frac pumps requires maintenance during the well stimulation operation, personnel generally service the subject frac pump, e.g. frac pump 70, while well stimulation operations continue. The safety shield 20 provides impact protection for the personnel working on frac pump 70 by segregating them from the neighboring treating iron 78 and the surrounding frac pumps. The safety shield 20 provides protection that gives workers time to move away from potential harm. Additionally, the safety shield 20 is easy to move from one location to another to accommodate, for example, maintenance of other frac pumps. In many applications, the lightweight impact panels 24 and stand 22 enable the safety shield 20 or safety shield components to be hand carried from one location to another. This portability and ease of setup/tear down greatly reduces the cost and improves the efficiency of providing a safety shield at desired locations throughout a given well site.

One or more safety shields 20 can be deployed in a variety of configurations for use at many types of well sites. The actual size and configuration of each safety shield can be selected according to the parameters of a given well site environment or well site application. The one or more safety shields also can be integrated with individual or simultaneous operations and can be used in cooperation with many types of well equipment.

Accordingly, although only a few embodiments of the present invention have been described in detail above, those of ordinary skill in the art will readily appreciate that many modifications are possible without materially departing from the teachings of this invention. Such modifications are intended to be included within the scope of this invention as defined in the claims.

What is claimed is:

1. A method for using a safety shield while performing oilfield service operations, comprising:

providing a safety shield comprising a fabricated stand and at least one impact panel comprising a material substantially lighter than steel;

positioning the safety shield at a first location at a wellsite without covering a well of the wellsite, the first location comprising a position between a first operation and a second operation therefore segregating a first group of workers for the first operation from a second group of workers for the second operation; and moving the safety shield to a second location at the wellsite without covering a well of the wellsite, the second location comprising a position between a third operation and at least one of a first operation and a second operation therefore segregating a third group of workers for the third operation from at least one of the first group of workers and the second group of workers.

2. The method as recited in claim 1, wherein the safety shield further comprises a hinged connector between a first impact panel and a second impact panel, the method further comprising changing a relative orientation of the portable fabricated stand and the first and second impact panels by pivoting the panels via the hinged connector.

3. The method as recited in claim 1, wherein positioning comprises positioning the safety shield such that the at least one impact panel is vertical.

4. The method as recited in claim 1, wherein the first operation, second operation, and third operation each comprise an operation selected from the operations consisting of: a fracturing operation, a perforating operation, a well drilling operation, and a production operation.

5. The method as recited in claim 1, wherein the first operation comprises a frac pump service operation and wherein the second operation comprises a well stimulation operation.

6. The method as recited in claim 1, wherein positioning comprises positioning the safety shield around an entire circumference of a wellhead where a well operation is being performed.

7. The method as recited in claim 1, wherein each of the at least one impact panels comprises a Kevlar® fiber material.

8. A method, comprising:

forming a plurality of impact panels comprising a material substantially lighter than steel;

mounting the plurality of impact panels to a portable stand with at least one quick connect fastener, the panels and stand able to be hand carried;

positioning the portable stand and the impact panels at a well site adjacent a well undergoing an operation comprising an operation selected from the operations consisting of: a drilling operation, a well stimulation operation, a fracturing operation, and a perforating operation; and orienting the impact panels to segregate a first group of workers conducting the operation from a second group of workers in the area without covering the well.

9. The method as recited in claim 8, wherein forming comprises forming the plurality of impact panels from a Kevlar® fiber material.

10. The method as recited in claim 8, wherein mounting comprises connecting the panels with at least one hinged connector and mounting the impact panels to an adjustable portable stand with the at least one quick connect fastener that can be positioned in a plurality of configurations.

11. The method as recited in claim 8, wherein positioning comprises positioning the portable stand and the plurality of impact panels to provide protection at an individual well operation.

12. The method as recited in claim 8, wherein positioning comprises positioning the portable stand and the plurality of impact panels to segregate independent well operations from each other.

* * * * *